United States Patent [19]

Favre

[11] 4,157,180

[45] Jun. 5, 1979

[54] ADJUSTABLE SUPPORT FOR A HIGH JUMP BAR

[76] Inventor: Marcel Favre, 119 rue des Moulins, 1400 Yverdon, Switzerland

[21] Appl. No.: 860,239

[22] Filed: Dec. 13, 1977

Related U.S. Application Data

[63] Continuation of Ser. No. 674,275, Apr. 6, 1976, abandoned.

[30] Foreign Application Priority Data

Apr. 9, 1975 [CH] Switzerland ..... 4690/75

[51] Int. Cl.[2] ..... A63B 1/06

[52] U.S. Cl. ..... 272/103; 248/125; 403/104

[58] Field of Search ..... 272/102, 103; 182/209; 248/125

[56] References Cited

U.S. PATENT DOCUMENTS

| | | | |
|---|---|---|---|
| 1,737,108 | 11/1929 | Craig | 272/103 |
| 2,900,194 | 8/1959 | Ward et al. | 272/103 |
| 3,606,226 | 9/1971 | Bell | 186/206 |

FOREIGN PATENT DOCUMENTS

| | | | |
|---|---|---|---|
| 27051 of | 1913 | United Kingdom | 403/384 |

*Primary Examiner*—Richard J. Johnson

*Attorney, Agent, or Firm*—Cushman, Darby & Cushman

[57] ABSTRACT

Adjustable support for a high jump bar, provided with a horizontal platform (2) for bearing one of the free ends of the bar. The support comprises an arch shaped member (6) one of the branches of which is connected to the support adjacent to the horizontal platform and the other branch of which is flexible and extends at least approximately vertically towards the base of the jump post in order to guide the bar in its fall.

6 Claims, 4 Drawing Figures

Figure 4:
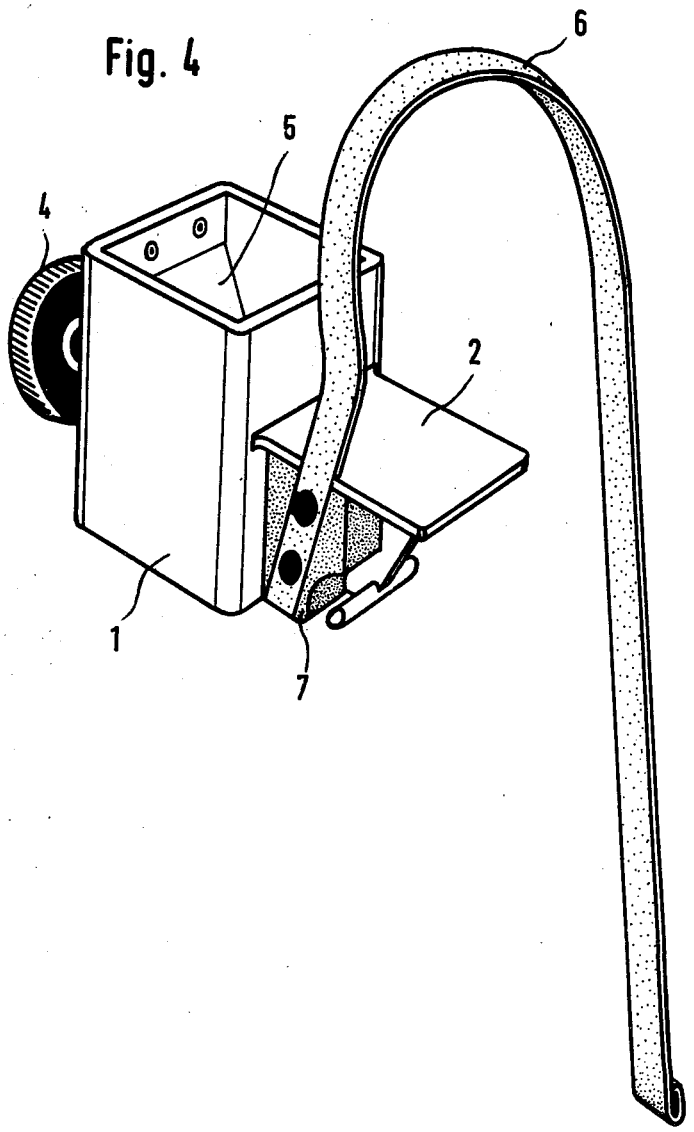

Fig. 1
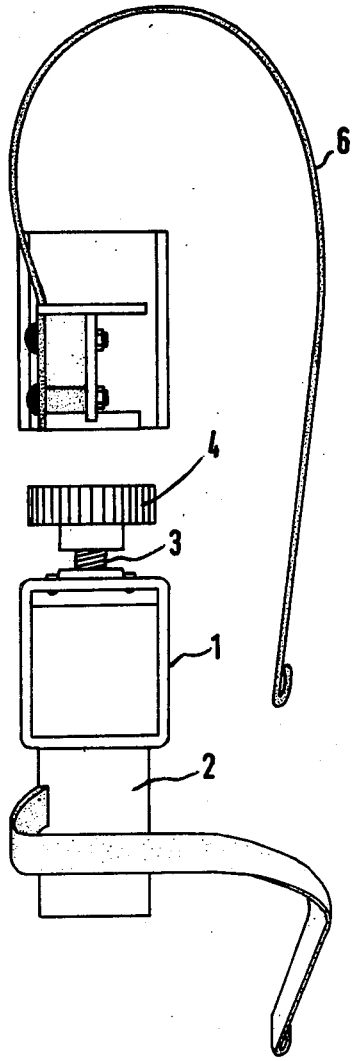
Fig. 2
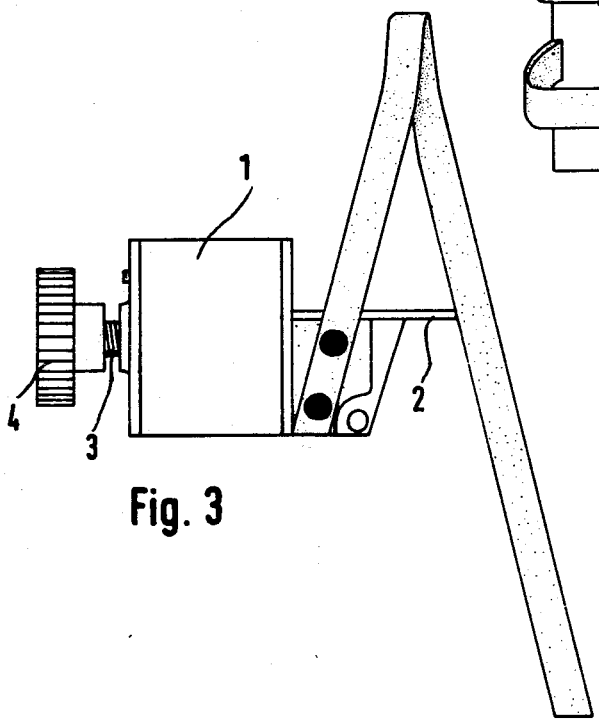
Fig. 3

ADJUSTABLE SUPPORT FOR A HIGH JUMP BAR

The present invention relates to adjustable supports for high jump bars provided with a horizontal platform intended to bear one of the free ends of the bar.

Sliding bar supports are already known which are adjustable by means of a locking screw. The high jump bars rest on these supports to which they are not fixed for security reasons. According to the competition regulations in use, the fall of the bar sanctions the failure of a jump attempt.

As the fall of the bar precedes that of the jumper and a failure is accompanied by a projection of the bar forwards, the bar very often falls on the same place as the athlete when he lands on the mat. Besides the large number of bruises caused by this defect and thereby the fear of jumping, the high jump bars are sometimes damaged, the light metal battens are deformed and those made of glass fibre are broken.

The present trend to use the new jumping technique called "Fosbury" increases the number and seriousness of this type of accident : since this style involves jumping over the bar backwards and landing on the back, the back and the arms are especially at risk if the jumper falls onto the bar.

The object of the invention is to provide a bar support preventing the fall of the bar on the landing surface of the jumper.

The support according to the invention is characterized in that it comprises an arch shaped member one of the branches of which is connected to the support and adjacent to the horizontal platform and the other flexible branch of which extends at least approximately vertically towards the base of the jump post in order to guide the bar in its fall.

According to a preferential embodiment, the arch shaped member is constituted of an elastic strip of metal which can be deformed so that its curve can be modified during use. It can be made of metal, synthetic material or partially in metal and partially in synthetic material. In order to avoid the high jump bar falling on the ground, the lower part of the free branch of the arch can even be slightly curved upwards.

The present invention will be better understood by referring to the description of a practical embodiment and to the attached drawings in which FIG. 1 is a vertical section of the support according to the invention FIG. 2 represents this support seen from above FIG. 3 is a cross-section and FIG. 4 is a perspective view of the support of FIG. 1

With reference to the above figures, the support of the high jump bar (not shown) comprises a tubular element 1 of square or rectangular section equipped with a platform 2 on which will be placed one of the ends of the bar. This element 1 is usually fixed onto the vertical jump posts (not shown) at a certain height chosen by the athlete for his jump attempts. The locking of the support on the post is made in a known manner by means of a locking screw 3, connected to a serrated wheel 4 and which presses more or less heavily on an elastic plaquette 5 fixed to the inside of the tubular element 1.

One of the branches of an arch shaped member 6, made by means of a strip of metal, of synthetic material or a combination of these two materials, is connected in a known manner to a block 7, preferably cast from a piece of light alloy, to the tubular element 1. The other branch, flexible and elastic, extends substantially vertically towards the base of the jump posts.

During use, if an athlete fails a jump attempt and knocks the jump bar, the latter falls from platform 2 and is guided by the free branch of the arch 6 and ends up falling in the proximity of the base of the jump posts, i.e. at a place where there is no risk of it hurting or injuring the jumper.

Furthermore, the end of the free branch of the arch shaped member 6 could be slightly curved upwards, in order to prevent the jump bar falling to the ground.

The described support, equipped with the arch shaped member constitutes an effective security device. Moreover, the arch shaped member is easily adaptable to all types of existing supports.

What is claimed is:

1. An adjustable support adapted to be mounted on a jump post for supporting a jumping bar comprising:

a tubular support member slidably mounted on said jump post, said tubular support member including a horizontally disposed platform for supporting an end of said jumping bar;

a locking means connected to said tubular support member for securing said member at a selected height on said jump post; and a flexible and elastic arch-shaped member mounted at one end to said support member and forming a loop extending from below said platform on one side thereof above and around the horizontal surface of said platform in spaced relationship with respect thereto, the other end of said arch-shaped member extending substantially vertically from above to below said platform in spaced relationship with respect to said platform, the space between said arch-shaped member and said horizontal platform being at least greater than the cross-sectional area of said jumping bar to thereby permit said jumping bar to be forced from said platform and directed toward a location proximate the base of said jump post.

2. A support as claimed in claim 1, wherein the arch shaped member is constituted of an elastic strip of metal which can be deformed so that its curved shape can be modified during use.

3. A support as claimed in claim 1, wherein the arch shaped member is made of metal.

4. A support as claimed in claim 1, wherein the arch shaped member is made of synthetic material.

5. A support as claimed in claim 1, wherein the arch shaped member is made partially of metal and partially of synthetic material.

6. An adjustable support adapted to be mounted on a jump post for supporting a jumping bar comprising:

a tubular support member slidably mounted on said jump post, said tubular support member including a horizontally disposed platform for supporting an end of said jumping bar;

a locking means connected to said tubular support member for securing said member at a selected height on said jump post; and a flexible and elastic arch-shaped member mounted at one end to said support member proximate said horizontal platform, said arch-shaped member extending upwardly and away from said horizontal platform to form a loop extending above and around said horizontal platform in a direction facing away from the side of said jump post in which a jump is initiated, the other end of said arch-shaped member being substantially vertically disposed and extending from above the level of said horizontal platform to a location below said horizontal platform and in spaced relationship with respect thereto, the distance between said other end of said arch-shaped member and said horizontal platform being at least greater than the cross-sectional area of said jumping bar to thereby permit said jumping bar to be forced from said horizontal platform with said other end of said arch-shaped member guiding said jumping bar downwardly to a position proximate the base of said jump post.

* * * * *